US009572460B2

(12) United States Patent
Petocchi et al.

(10) Patent No.: US 9,572,460 B2
(45) Date of Patent: Feb. 21, 2017

(54) TOWEL DISPENSER

(75) Inventors: Ermanno Petocchi, Versailles, KY (US); Howard Carter, Frankfort, KY (US)

(73) Assignee: Wausau Paper Towel & Tissue, LLC, Mosinee, WI (US)

( * ) Notice: Subject to any disclaimer, the term of this patent is extended or adjusted under 35 U.S.C. 154(b) by 484 days.

(21) Appl. No.: 12/583,190

(22) Filed: Aug. 13, 2009

(65) Prior Publication Data

US 2011/0036855 A1 Feb. 17, 2011

(51) Int. Cl.
*A47K 10/36* (2006.01)

(52) U.S. Cl.
CPC ..... *A47K 10/3612* (2013.01); *A47K 10/3625* (2013.01); *A47K 2010/365* (2013.01); *A47K 2010/3668* (2013.01); *Y10T 83/889* (2015.04); *Y10T 225/22* (2015.04); *Y10T 225/23* (2015.04); *Y10T 225/255* (2015.04)

(58) Field of Classification Search
CPC A47K 10/36; A47K 10/3606; A47K 10/3612; A47K 2010/3668; A47K 10/24; A47K 10/26; A47K 10/32; A47K 10/34; A47K 10/3625; A47K 10/44; A47K 2010/365; Y10T 83/889; Y10T 225/22; Y10T 225/23; Y10T 225/238; Y10T 225/255
USPC ..... 83/648; 225/23, 32, 39, 54
See application file for complete search history.

(56) References Cited

U.S. PATENT DOCUMENTS

| | | | | |
|---|---|---|---|---|
| 2,809,082 | A | 10/1957 | Marcuse | |
| 2,869,951 | A | 1/1959 | Wooster | |
| 5,772,291 | A * | 6/1998 | Byrd et al. | 312/34.22 |
| 6,105,898 | A * | 8/2000 | Byrd et al. | 242/564.1 |
| 7,841,556 | B2 * | 11/2010 | Elliott et al. | 242/564.2 |
| 8,162,252 | B2 * | 4/2012 | Cittadino et al. | 242/560 |
| 2007/0236110 | A1 * | 10/2007 | Kling | 312/34.4 |
| 2008/0116314 | A1 | 5/2008 | Elliott et al. | |
| 2008/0121649 | A1 * | 5/2008 | Kistner | 221/17 |

FOREIGN PATENT DOCUMENTS

| | | |
|---|---|---|
| WO | WO 2006/071148 | 7/2006 |
| WO | WO 2007/011747 | 1/2007 |
| WO | WO 2007067106 | 6/2007 |

OTHER PUBLICATIONS

U.S. Appl. No. 12/583,189, filed Aug. 13, 2009; Carter et al.
Extended International Search Report for EP 2 283 757 A2 dated Jan. 28, 2014.

* cited by examiner

*Primary Examiner* — Clark F Dexter
(74) *Attorney, Agent, or Firm* — Merchant & Gould P.C.

(57) ABSTRACT

A paper towel dispenser assembly including a support frame that receives a continuous length of pleated paper toweling. The paper towel dispenser assembly further including a sensor that actuates dispensing of an end of the continuous length of pleated paper toweling and a cutter that cuts a discrete towel from the end of the continuous length of pleated paper toweling.

18 Claims, 8 Drawing Sheets

TOWEL DISPENSER

FIELD OF THE TECHNOLOGY

The present disclosure relates generally to paper towel dispensing devices, and various methods associated with such devices. More particularly, this disclosure relates to a paper towel dispenser that dispenses a discrete towel sheet, and various methods associated with such a paper towel dispenser.

BACKGROUND

A variety of paper towel dispensing arrangements currently exist. One common arrangement includes a paper towel dispenser having pre-folded, interleaved paper towels or sheets that are pulled from an opening in the dispenser. The paper towels are interleaved so that a tab of a second following paper towel is delivered when a first paper towel is pulled from the dispenser. This type of paper towel dispenser is typically recessed into a wall structure, such as a restroom wall in the vicinity of a restroom sink.

There are a number of disadvantages to the interleaved paper towel dispensers. One disadvantage is that pre-folded paper towels are relatively expensive, because the towels must be pre-cut to the desired length and interleaved (i.e., interwoven or overlapped), each of which adds to manufacturing costs. Another disadvantage is that these dispensers sometimes dispense more than one sheet of pre-folded paper towel at a time, whether the user intended to take more than one sheet or not. The extra paper towels are often discarded without use, or left on the restroom sink, for example, where the extra towels become wet and possibly contaminated.

Improvements to paper towel dispensers, generally to eliminate waste of paper towels and provide a user with an easy to use device, is needed.

SUMMARY

One aspect of the present invention relates to a paper towel dispenser assembly that receives a continuous length of pleated paper toweling. The pleated paper toweling is dispensed to a user upon receiving a paper towel request. Another aspect of the present invention relates to the upgrade of an existing pre-fold, pre-cut, interleaved paper towel dispenser. The method includes providing a paper towel dispenser assembly sized to fit within the existing framework of the towel dispenser, the assembly being configured to deliver a discrete paper towel from a continuous length of pleated paper toweling.

A variety of examples of desirable product features or methods are set forth in part in the description that follows, and in part will be apparent from the description, or may be learned by practicing various aspects of the disclosure. The aspects of the disclosure may relate to individual features as well as combinations of features, including combinations of features disclosed in separate embodiments. It is to be understood that both the foregoing general description and the following detailed description are explanatory only, and are not restrictive of the claimed invention.

DETAILED DESCRIPTION

Reference will now be made in detail to exemplary aspects of the present disclosure that are illustrated in the accompanying drawings. Wherever possible, the same reference numbers will be used throughout the drawings to refer to the same or like parts.

The present disclosure relates to a towel dispenser and towel dispenser assembly. In one embodiment, the towel dispenser assembly is sized and constructed for installation within an existing towel dispenser. The existing towel dispenser can be located within a recessed space in a wall or mounted flush to a wall. The existing towel dispenser can include, for example, a cabinet recessed within a wall, such as those dispensers designed for manual dispensing of individual pre-cut and pre-folded paper towels.

As previously described, such pre-cut paper towel dispensers often dispense more individual towels than what is needed by a single user, resulting in towel waste and/or mess. The extra dispensed towels are sometimes left out in the open, for example upon a sink ledge, where the extra towels can become wet and/or contaminated. The present towel dispenser eliminates unintended dispensing of paper towels. The present towel dispenser further fits within existing towel dispenser structure without significant modification to reduce costs associated with upgrading a facility's towel dispensing system. In the alternative, the present towel dispenser assembly can be provided in a new dispenser construction or a different dispenser configuration having a low-profile spatial requirement similar to that of manual pre-cut paper towel dispensers.

Figure 1:
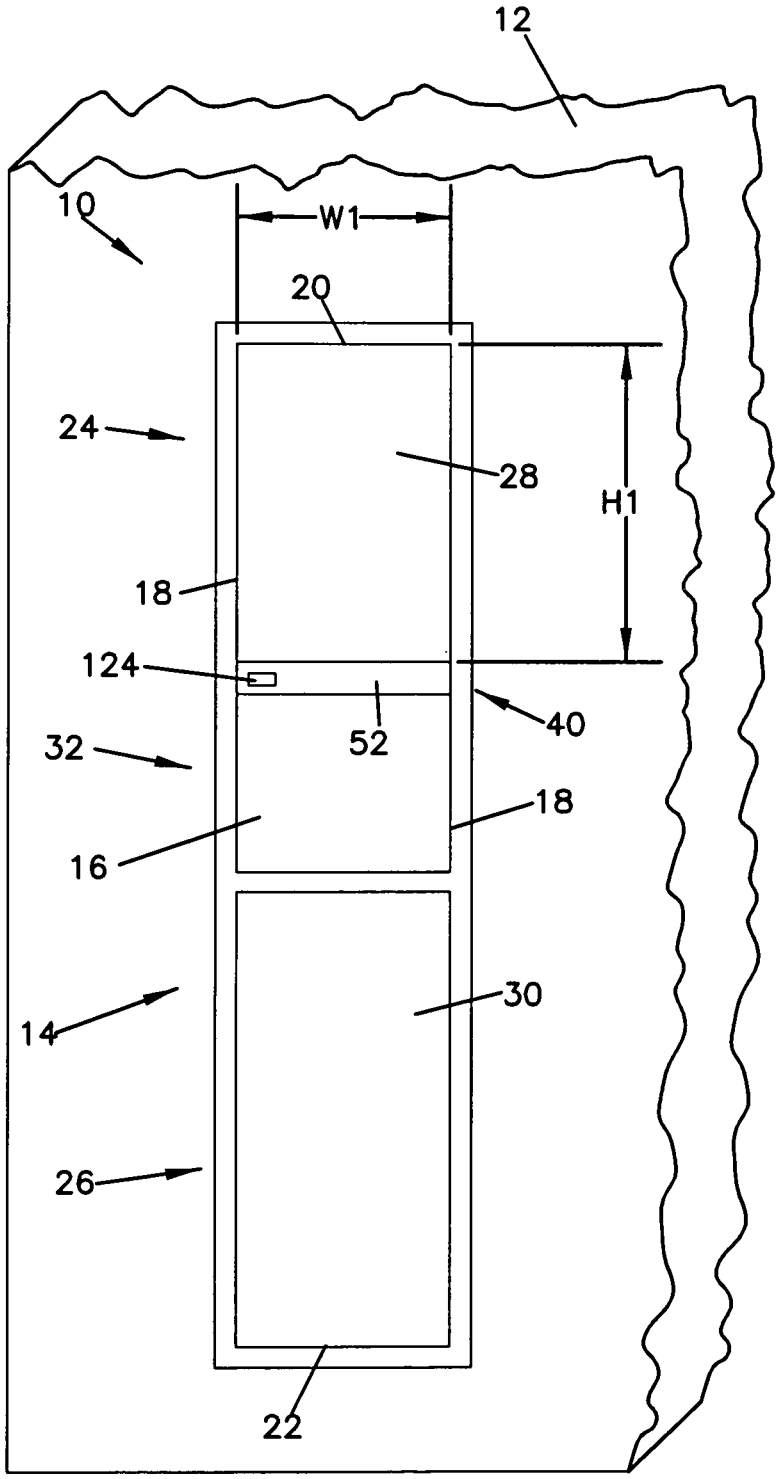
FIG. 1 is a front view of one embodiment of a towel dispenser, in accordance with the principles disclosed.
Figure 3:
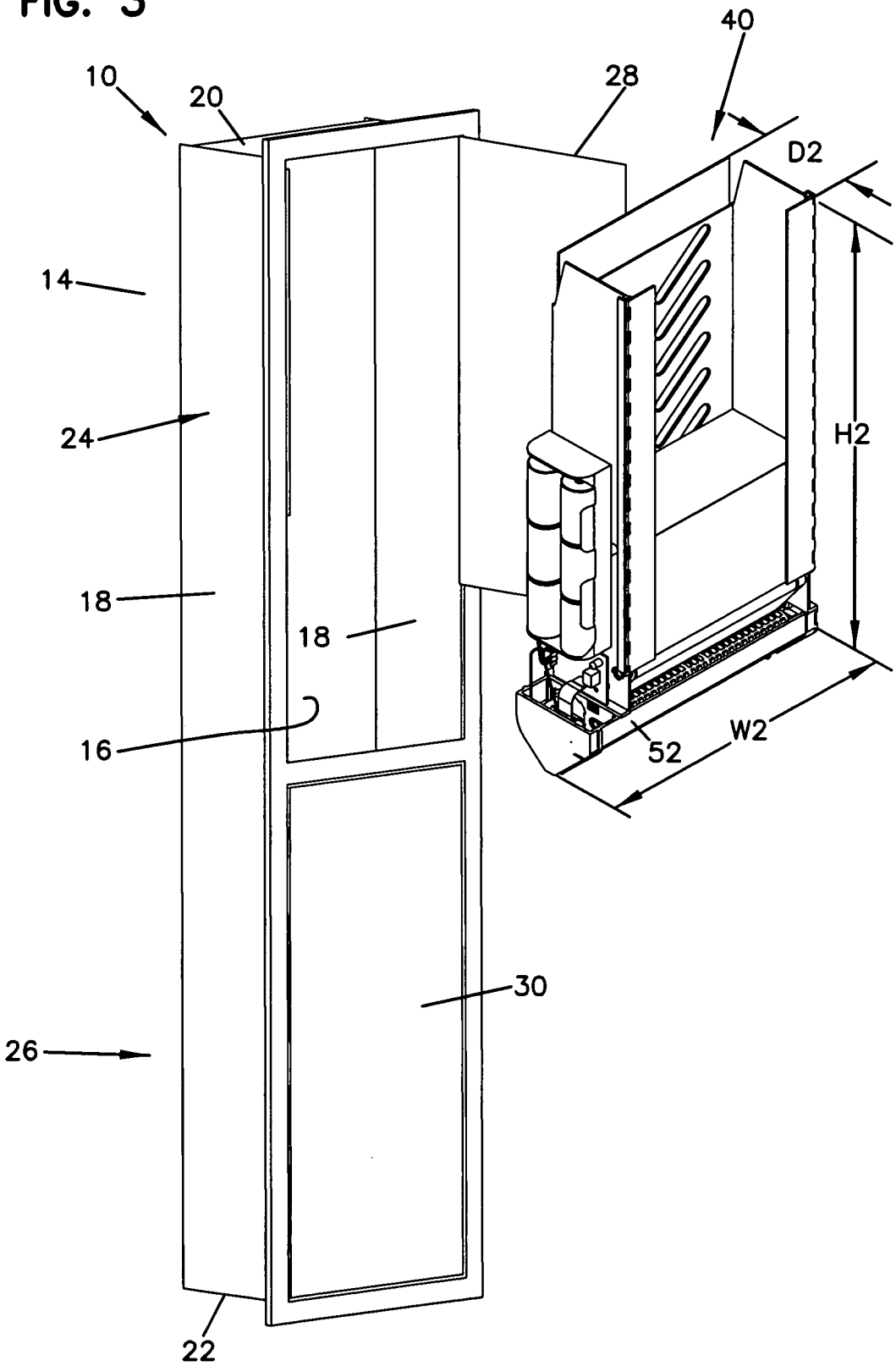
FIG. 3 is a partially-exploded, front perspective view of the towel dispenser of FIG. 1.

Referring now to FIG. 1, one embodiment of a towel dispenser 10 in accordance with the principles disclosed is illustrated. The towel dispenser 10 is located within a recessed space in a wall 12. The towel dispenser 10 generally includes a framework structure, such as a cabinet 14. Referring to FIGS. 1 and 3, the illustrated cabinet 14 includes a rear wall 16, side walls 18, a top wall 20, and a bottom wall 22. The cabinet 14 defines an upper cabinet region 24 and a lower cabinet region 26. A front cabinet cover 28 encloses the upper cabinet region 24. The lower cabinet region 26 can be used for storage or receipt of used towels, and can also include a lower cabinet cover 30 that encloses the lower cabinet region 26.

Figure 2:
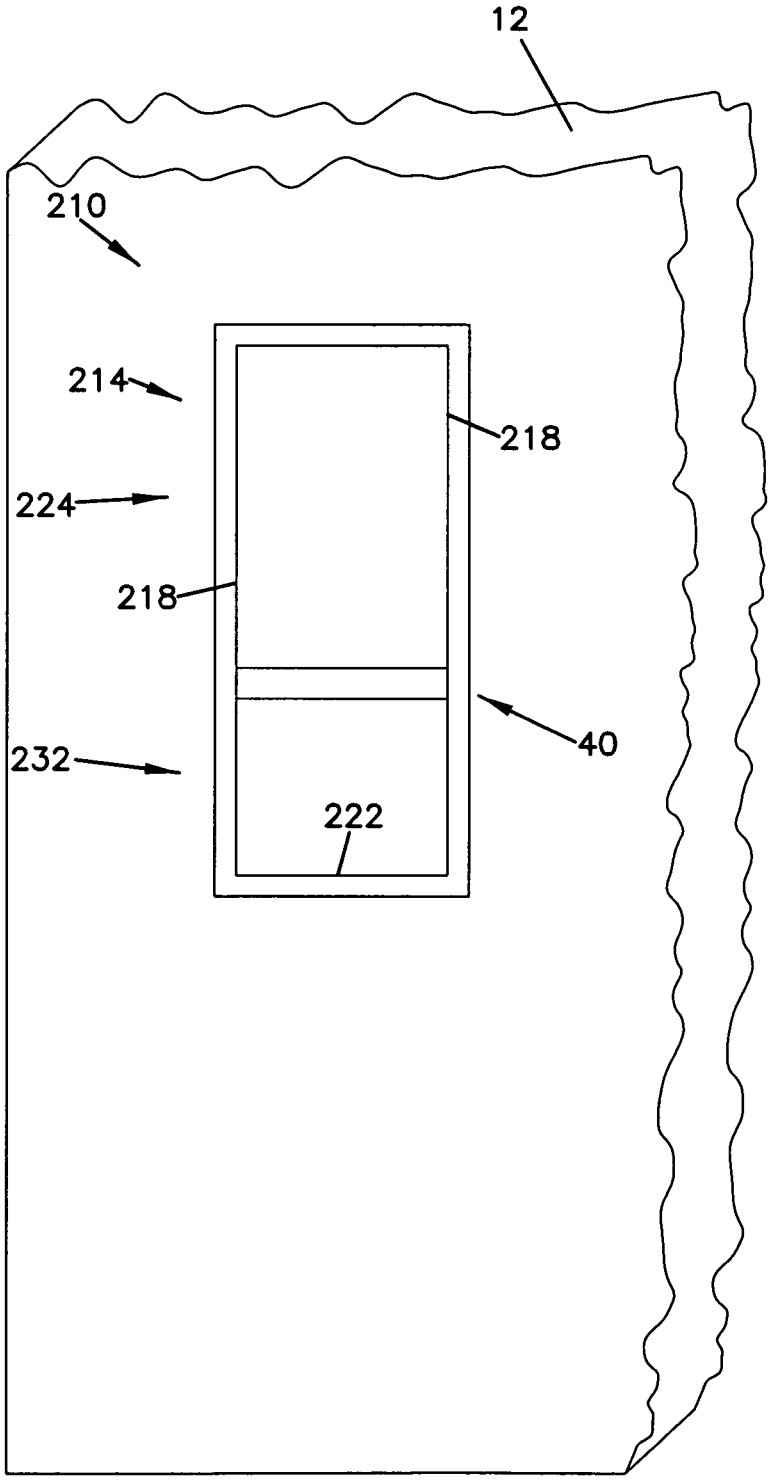
FIG. 2 is a front view of another embodiment of a towel dispenser, in accordance with the principles disclosed.

A towel dispensing region 32 (FIG. 1) is located between the upper cabinet region 24 and the lower cabinet region 26. The towel dispensing region 32 is the region at which a user obtains a paper towel. Referring to FIG. 2, an alternative dispenser 210 is illustrated. In this embodiment, framework structure 214 of the dispenser 210 includes only an upper cabinet region 224 and a dispensing region 232 located beneath the upper cabinet region. The lower region (e.g. 26)

in this alternative embodiment is eliminated. The dispensing region 232 may or may not be surrounded by framework structure. For example, in a recess-mounted application, the dispensing region 232 may be defined by walls of the framework structure (e.g., 218, 222); in a flush-mounted application, for example, the dispensing region 232 may be defined by the open space located beneath the dispenser 210.

The remainder of description refers to the framework structure 14 of FIG. 1, although it is to be understood that the disclosed principles apply similarly to framework structure 214, as well as other types of framework that can be used in accordance with the principles disclosed.

Figure 5:
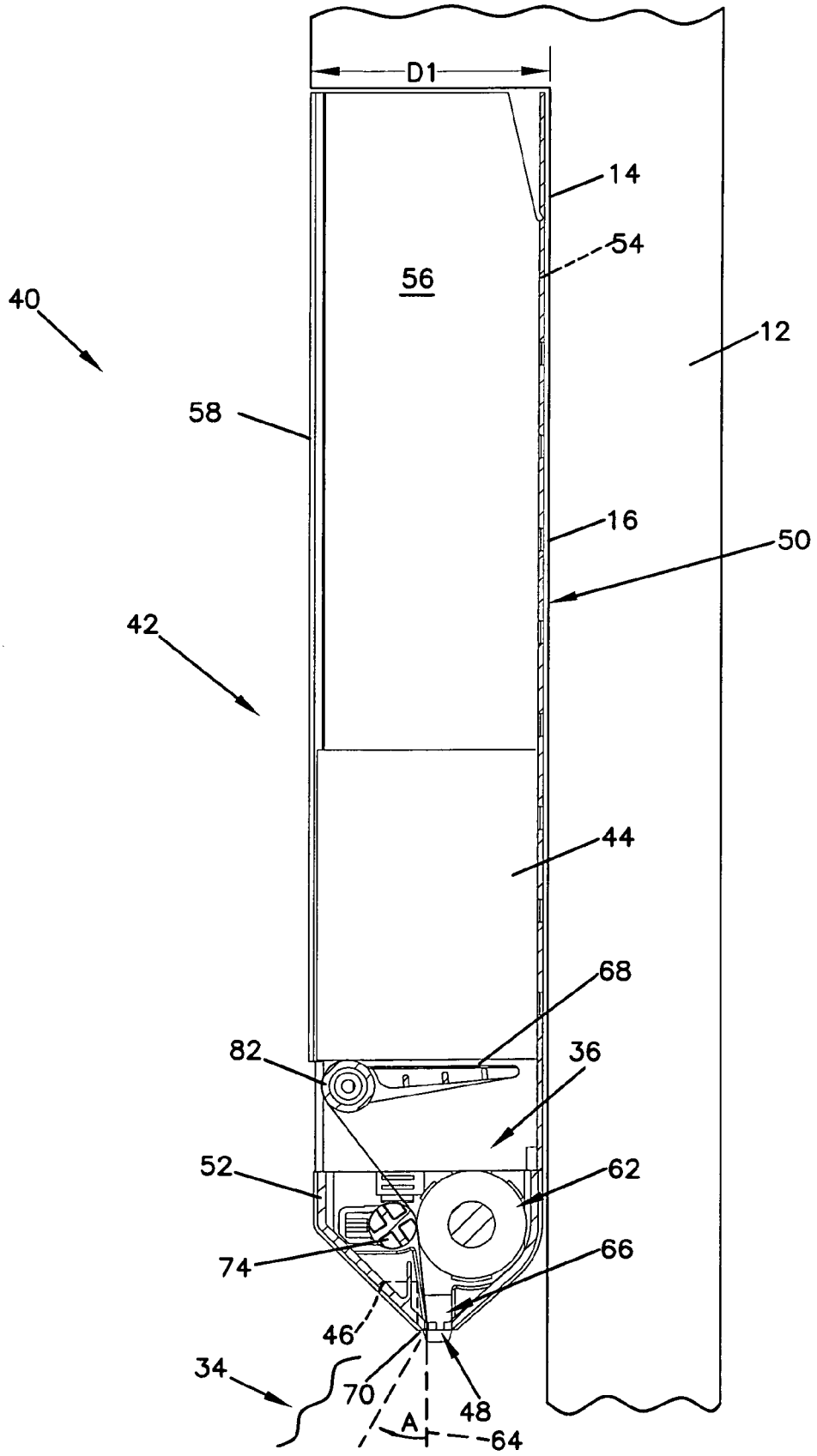
FIG. 5 is a cross-sectional view of the towel dispenser assembly of FIG. 4, taken along line 5-5.

Referring again to FIGS. 1 and 3, a paper towel dispenser assembly 40 is mounted within the interior of the upper region 24 of the cabinet 14. As previously described, the cabinet can be that of an existing towel dispenser or that of a new dispenser construction. In standard existing towel dispensers, the interior of the upper region 24 of the cabinet has a width W1 (FIG. 1), a height H1, and a depth D1 (FIG. 5). The width W1 commonly ranges between about 8 inches and about 16 inches; the height H1 commonly ranges between about 16 inches and about 24 inches; and the depth D1 commonly ranges between about 4 inches and about 8 inches. In such a standard existing towel dispenser, the interior holds a stack of pre-folded individual paper towels.

The dispenser assembly 40 is sized and shaped to fit within the interior space of the upper region 24 of the cabinet of an existing towel dispenser. In particular, the dispenser assembly 40 has a width W2 (FIG. 3), a height H2, and a depth D2 that corresponds to the width W1, height H1, and depth D1 of the upper region cabinet interior. In one embodiment, the width W2 of the assembly 40 is between about 10 and 12 inches, the height H2 is between about 14 and 18 inches, and the depth D2 is between about 3 and 5 inches. As can be understood, the assembly 40 can be constructed with other dimensional specifications as needed to fit a particular application. As shown in FIG. 1, when the front cabinet cover 28 is closed, a majority of the dispenser assembly 40, including the entire dispenser portion which stores the toweling, is enclosed within the upper region 24 of the cabinet.

Figure 4:
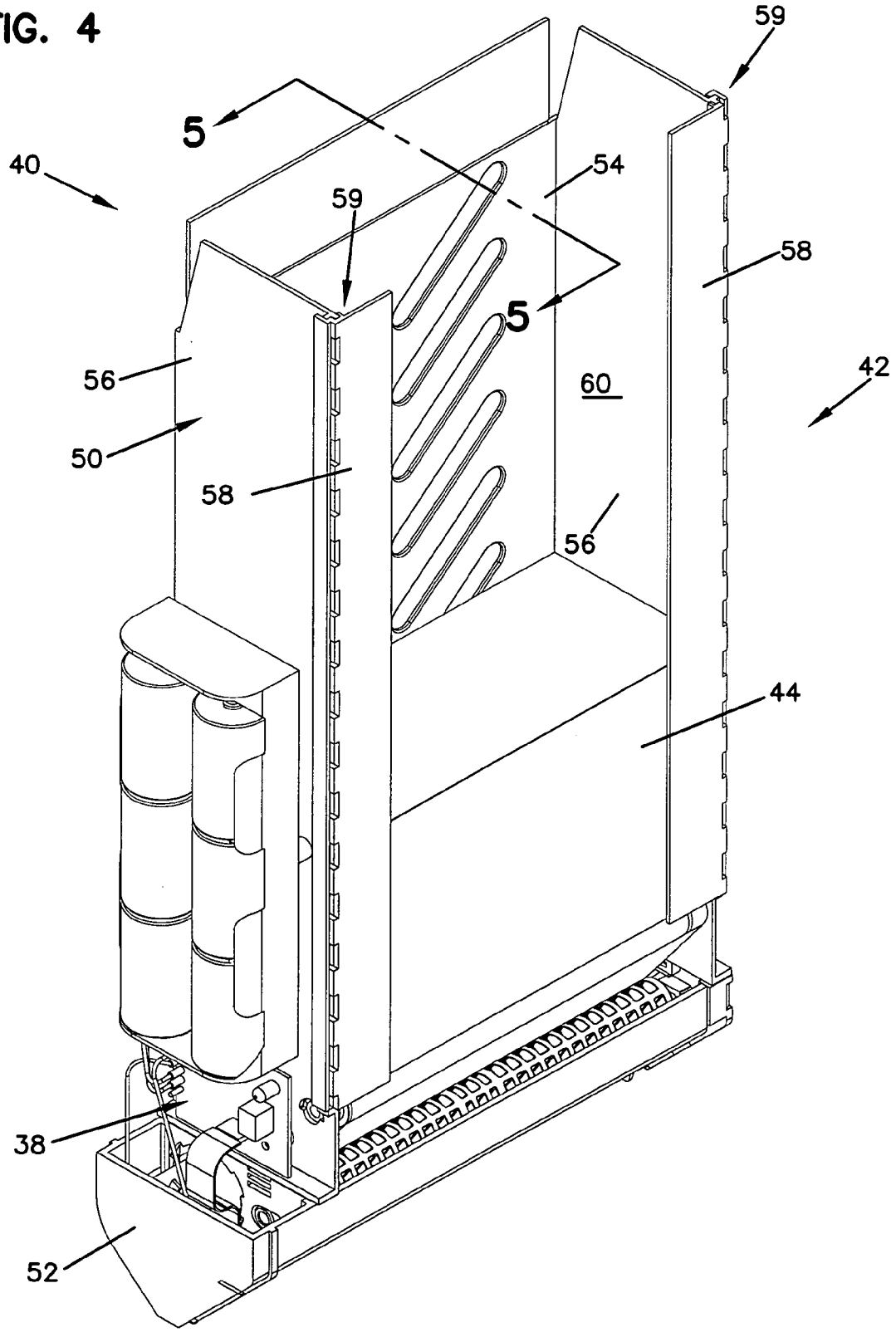
FIG. 4 is a front perspective view of a towel dispenser assembly of the towel dispenser of FIGS. 1-3, shown in isolation.

Referring now to FIGS. 4 and 5, the paper towel dispenser assembly 40 of the present disclosure generally includes a dispenser housing 42 that holds a continuous length of pleated paper toweling or substrate 44. The dispenser assembly 40 further includes a sensor 46 (FIG. 5) that activates dispensing operation of the paper toweling 44, and a cutting mechanism or cutter 48 (FIG. 5) that cuts the paper toweling. What is meant by "continuous length" of pleated paper toweling is that the paper toweling is in the form of a paper web, as opposed to individual pre-cut sheets of paper towels. What is meant by continuous length of "pleated" paper toweling is that the length includes a plurality of fold lines, in contrast to a roll, for example. In the illustrated embodiment, the fold lines are alternating. The continuous length of pleated paper toweling accordingly has a rectangular stacked shape. Additionally, the continuous length of pleated paper toweling is non-perforated (i.e., the web has no spaced separation lines). Further details of pleated paper toweling that can be used in the present dispenser assembly are provided in U.S. application Ser. No. 12/583,189, which application is incorporated herein by reference.

Referring still to FIGS. 4 and 5, the dispenser housing 42 of the dispenser assembly includes a support frame 50 and a base 52 that connects to the support frame 50. The support frame 50 has a generally rectangular construction. The generally rectangular construction corresponds to the rectangular stacked shape of the continuous length of pleated paper toweling 44. The support frame 50 receives and stores the continuous length of pleated paper toweling 44. The support frame 50 is sized to fit entirely within the interior of the upper region (e.g., 24) of an existing cabinet.

Figure 6:
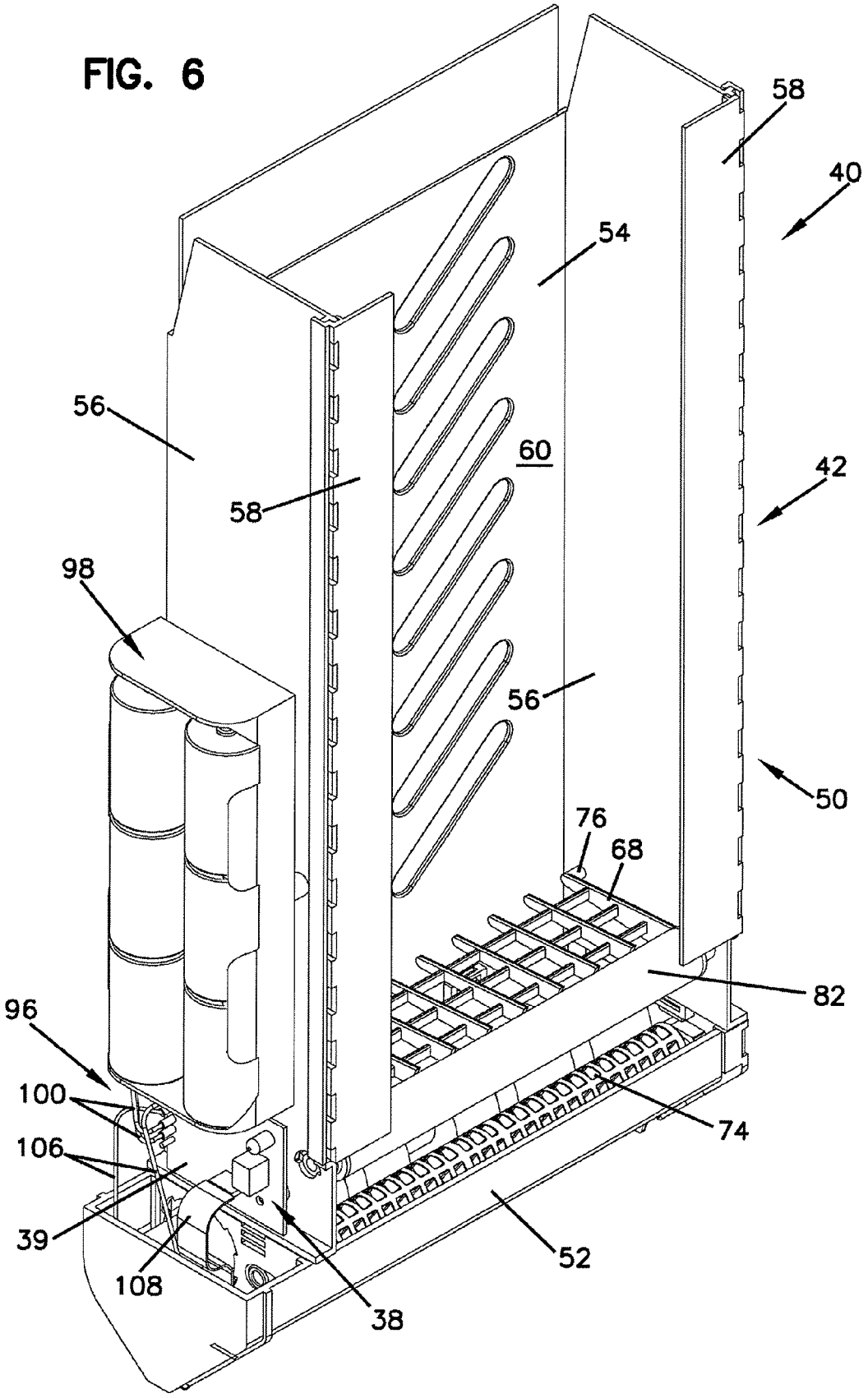
FIG. 6 is a front perspective view of the towel dispenser assembly of FIG. 4, shown without a stack of continuous pleated paper toweling.

The illustrated support frame 50 includes a rear panel 54, side panels 56, and front panels 58. The front panels 58 are attached to the side panels 55 by a sliding connection 59. As shown in FIG. 4, the front panels 58 retain the continuous length of pleated paper toweling 44 within an interior 60 of the support frame 50, but are spaced to allow access to the interior 60 when the toweling is loaded. Referring to FIG. 6, the support frame 50 includes a bottom or support platform 68 (e.g., plate, surface, grid, or bottom panel) that supports the continuous length of pleated paper toweling 44.

Figure 7:
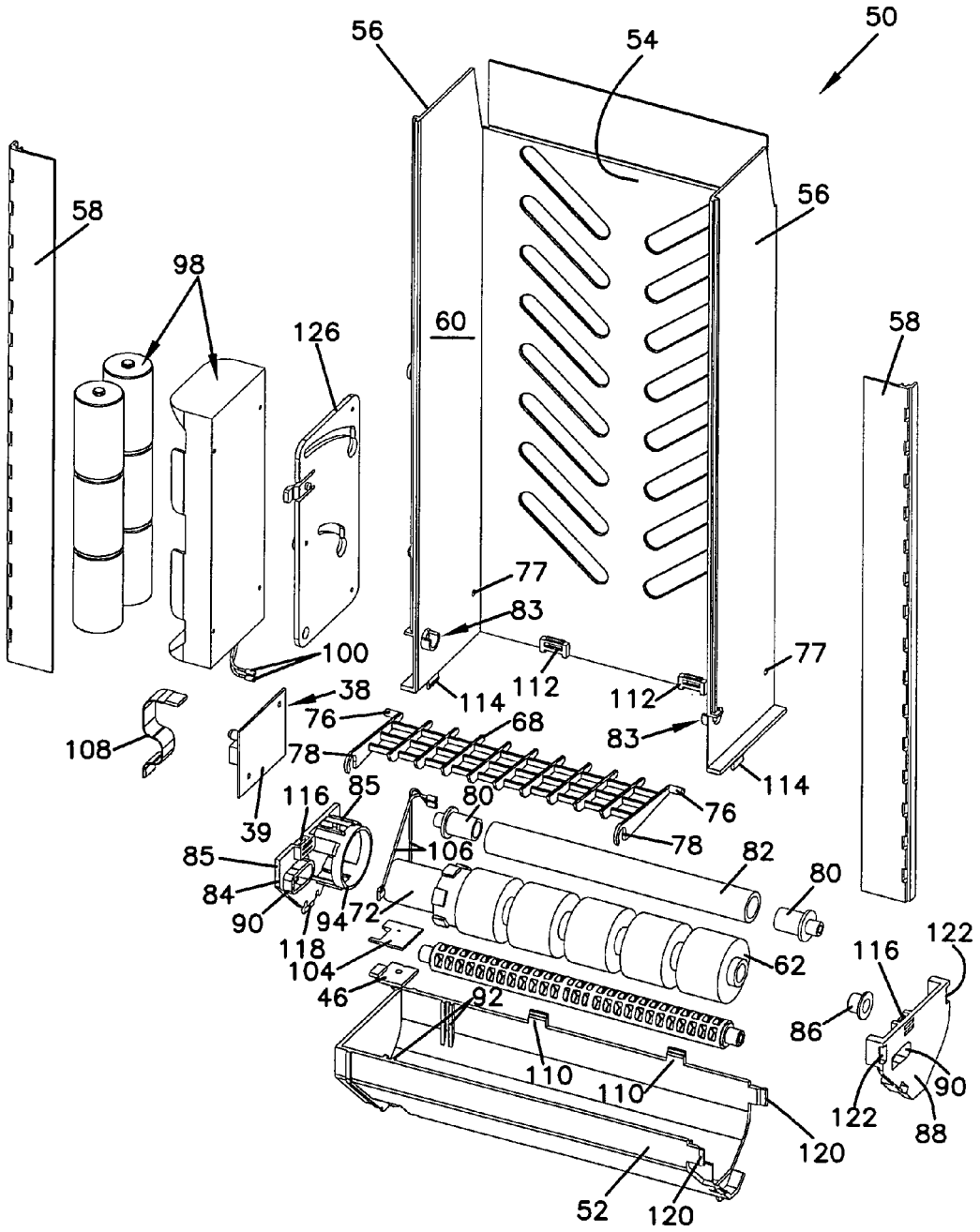
FIG. 7 is an exploded perspective view of the towel dispenser assembly of FIG. 6.

Referring to FIGS. 6 and 7, the bottom platform 68 has rear tabs 76 that engage apertures 77 (FIG. 7) formed in the side panels 56 of the support frame 50. The bottom platform 68 also has front notches or hook constructions 78 that hook or seat on hubs 80 that support a spacer roller 82. The hubs 80 are secured to side panels 56 of the support frame 50 at mounting locations 83. As shown in FIG. 6, the bottom platform 68 is positioned in a generally horizontal orientation when mounted relative to the side panels 56. As will be described hereinafter, the spacer roller 82 extends between the hubs 80 and is used in routing the continuous length of pleated paper toweling 44. The spacer roller 82 can alternatively have ends that attach directly to the side panels 56 of the support frame 50, and which ends can receive the hook constructions 78 of the support platform 68.

Figure 8:
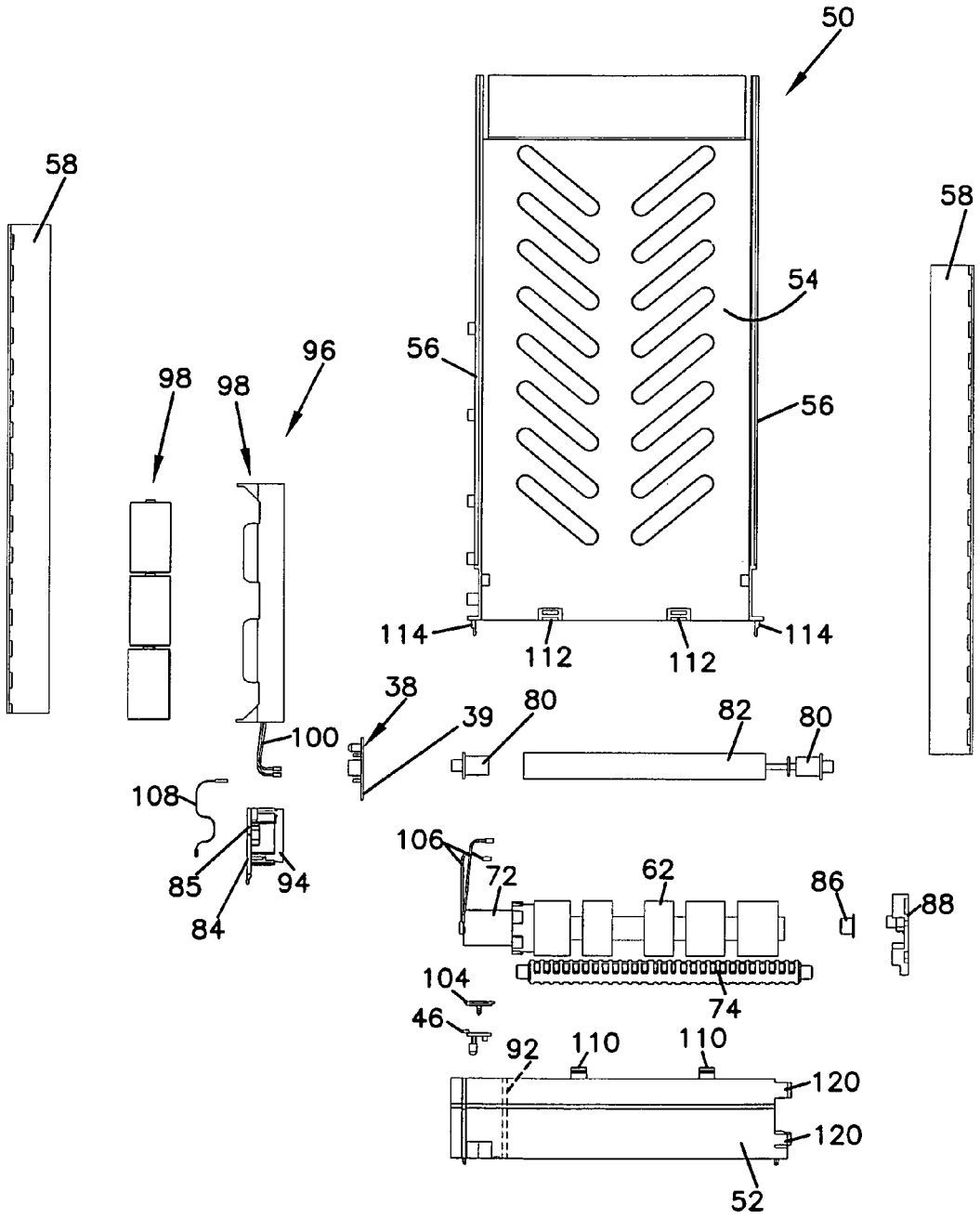
FIG. 8 is a front elevation exploded view of the towel dispenser assembly of FIG. 7.

Referring now to FIGS. 7 and 8, the base 52 of the dispenser housing 42 attaches to the bottom of the support frame 50. In particular, the base includes tabs 110 that attach to latch structure 112 provided on the rear panel 54 of the support frame 50. The side panels 56 include tabs 114 that attach to latch structure 116 provided in part by the base 52 (in particular, provided in an end or end plate 88 of the base and a motor bracket 84 secured to the base 52, which components are described in greater detail hereinafter).

Referring back to FIG. 5, in the illustrated embodiment, a drive assembly 36 of the dispenser assembly 40 is located beneath the support frame 50 and generally within the base 52. The drive assembly includes a drive roller 62 (e.g., a feed roller), a motor 72 (FIG. 8), and a nip or pinch roller 74. An end 64 of the continuous length of pleated paper toweling 44 is fed through the drive roller 62 and the pinch roller 74. The drive roller 62 rotates to dispense a predetermined length of the end 64 of the continuous length of pleated paper toweling through an opening or slot 66 formed in the base 52. The motor 72 of the drive assembly 36 is engaged with or coupled to the drive roller 62. During dispensing operation, the motor 72 drives the rotation of the drive roller to dispense the end 64 of the continuous length of pleated paper toweling 44.

The spacer roller 82 is located forward of the drive and pinch rollers 62, 74 of the drive assembly 36. The spacer roller 82 positions the web of continuous pleated paper toweling forward of the opening 66 in the base 52 of the dispenser assembly 40. When loaded for operation, the end 64 of the paper toweling is first routed forward around the spacer roller 82 and then routed rearward and between the drive roller 62 and the pinch roller 74.

Referring again to FIGS. 7 and 8, the motor bracket 84 is used to mount the motor 72 within the base 52 of the dispenser housing 42. In particular, the motor 72 is positioned within a collar portion 94 of the motor bracket 84; the motor bracket 84 is then positioned within the base 52.

Edges 85 of the motor bracket 84 slide within grooves or slots 92 provided in the base 52, and a latch 118 engages with corresponding structure (not shown) in the base to secure the motor bracket 84 relative to the base.

The drive roller 62 of the drive assembly 36 is supported at one end by engagement with the motor 72 and supported at the other end by a drive hub 86 that attaches to the end 88 of the base 52. The end 88 is attached to the base 52 by base tabs 120 that engage apertures 122 formed in the end 88. The end 88 is attachable and detachable for assembly purposes. In the alternative, the end of the drive roller 62 can attach directly to the end 88 of the base 52. The pinch roller is supported in relation to the drive roller 62 by positioning ends of the pinch roller 74 within apertures 90. One of the apertures 90 is formed in the end 88 of the base 52, the other aperture 90 is formed in the motor bracket 84.

The present dispenser assembly 40 further includes a controller 38. In the illustrated embodiment, the controller 38 is a printed circuit board 39 having control circuitry. Referring back to FIG. 6, the controller 38 is mounted to one of the side panels 56 of the support frame 50 adjacent to the motor 72. Various electrical connections are established with the controller 38. In particular, motor wires or leads 106 from the motor 72 are electrically coupled to the controller 38. An electrical connection (e.g., a flexible cable) 108 from the sensor 46 is also electrically coupled to the controller 38. The controller 38 controls and/or performs the following functions: determines when an object, such as a user's hand, is proximate to the sensor 46 and turns the motor 72 on; and senses when the predetermined length of toweling 44 has been dispensed, and turns the motor 72 off. In some embodiments, the controller 38 also senses when toweling 44 has become jammed within the dispenser housing 42, and can also create a delay between toweling dispenses.

Referring still to FIG. 6, a power supply 96 is electrically connected to the controller 38. The power supply 96 supplies power to the sensor 46 and the motor 72 by way of the control circuitry of the controller 38. In the illustrated embodiment, the power supply 96 includes a battery pack 98 having wires or leads 100 that connect to the controller 38. The battery pack 98 is secured to the side panel 56 of the support frame 50 by a bracket 126 (FIG. 7). In the alternative, the controller 38 can be powered by an electrical source by way of a transformer. The power supply 96 can include a number of different types of supplies (e.g., a 110 volt supply, a solar panel supply, etc.).

The controller 38 monitors and controls operation of the motor 72, and thereby controls the predetermined length of the toweling dispensed. In one embodiment, the controller 38 includes a programmable processor, which based upon a selected input entered into the processor, sets the predetermined length of toweling dispensed. The selected input is one of a plurality of inputs that can be selected; each input of the plurality being associated with a different predetermined length of dispense.

During installation or maintenance, the length of toweling dispensed can be set to a desired dispense length. As previously described, the continuous length of pleated paper toweling is non-perforated so that the length of toweling provided to a user can be different in different applications, as needed. In contrast, perforated towel webs have set towel sheet lengths that cannot be varied. In one application, the predetermined length dispensed to a user is between about 8 to 9 inches. In one embodiment, the predetermined length is associated with a time of dispense; accordingly the motor is turned off after a particular time associated with the dispense of a predetermined length. In another embodiment, a sensor can be used to detect the rotational position of the drive roller, for example, to determine what length of toweling has been dispensed.

As previously noted, the controller 38 can also control a delay between toweling dispenses. For example, the controller can be set to prevent the start of a new dispense until a predetermined time after the motor 72 has turned off from a prior dispense. In one application, the predetermined time is about 2 seconds. The controller 38 can also be configured to sense a jam in the dispenser housing 42 by sensing an amperage increase caused by an overload on the motor 72, for example.

Referring again to FIGS. 7 and 8, the sensor 46 mounts to the base 52 of the dispenser assembly 40. In the illustrated embodiment, when mounted, the sensor 46 is oriented such that an object positioned below the base 52 of the dispenser assembly 40 activates dispensing operation. In the alternative, the sensor can be oriented at an angle to sense an object downward and toward the front of the dispenser assembly (for example, at a 45-degree angle relative to vertical), or oriented to sense an object out in front of the dispenser assembly. As can be understood, the sensor can be oriented at various angular orientations depending upon the location of the dispenser assembly relative to a user.

Dispensing operation is activated automatically by the sensor 46 when a user initiates a towel request. The towel request can be initiated by, for example, positioning an object, such as a hand, in sensing proximity of the sensor without contacting the dispenser. In this manner, a user can avoid contact with viruses or bacteria left on the dispenser by prior users. The sensor can include, for example, a photo sensor that senses or detects changes in light intensity. In the illustrated embodiment, the sensor is an infra-red sensor including a source of infra-red light. The infra-red sensor senses or detects infra-red light reflected by an object. Other types of sensors can be used in accordance with the principles disclosed.

The sensor 46 is mounted at or adjacent to the bottom of the base 52. Referring to FIG. 8, a cover 104 can be placed over the sensor to protect the sensor 46 from debris or dust. As previously referred to, the sensor activates dispensing operation of the drive roller 62; i.e., the sensor 46 activates or sends a signal to the controller 38 which turns the motor 72 on to begin a dispensing operation.

Referring back to FIG. 5, the cutter 48 of the dispenser assembly 40 cuts the continuous length of pleated paper toweling 44 dispensed through the opening 66 of the base 52 to provide the user with a discrete towel 34. In the illustrated embodiment, the cutter 48 is a stationary cutter defined by the base 52. The cutter 48 includes a blade 70 having a sharp or serrated edge located relative to and forward of the end 64 of the continuous length of pleated paper toweling 44. In particular, the blade 70 is located adjacent to the opening 66 through which the end 64 of the toweling 44 is dispensed.

The blade 70 can be a separate component secured to the base 52 or formed as an integral part of the base. The blade 70 cuts or separates the discrete towel 34 from the end of the pleated paper toweling 44 when the user pulls the end 64 of the toweling 44 against the blade 70 of the cutter 48. As can be understood, the discrete towel 34 has a length that corresponds to the predetermined length established by the input to the controller. In some applications, the length of the discrete towel 34 is such that the discrete towel 34 has at least one fold line defined by the pleated paper toweling 44.

In one method of use, the paper towel dispenser assembly 40 is utilized to upgrade an existing towel dispenser that stores individual, interleaved sheets inside the existing towel dispenser. The interleaved sheets have ends that are interwoven or overlapped such that when one exposed end of a first single sheet is withdrawn from the existing dispenser, the end of a another single sheet is exposed for use.

FIG. 3 can be used as an example of an upgrade installation of an existing towel dispenser. Initially, the upper cabinet cover 28 is opened to access the interior and remove any existing pre-fold towel support construction (not shown) as necessary. The dispenser assembly 40 is then positioned and secured within the upper cabinet region 24. The assembly 40 can be secured by fasteners, engaging tabs, and/or adhesive material, for example. In one method, the installation includes securing the dispenser assembly 40 to the rear wall 16 of the existing framework (e.g., 14). The dispenser assembly 40 is sized and constructed such that the upper cover 28 can be closed after installation and need not be modified, replaced, or removed.

The installer establishes electrical connection between a power source and the controller 38 to supply power to the electrical components (e.g., the sensor 46 and the motor 72) of the assembly 40. In the illustrated embodiment, batteries are installed within the power pack 98 of the assembly 40 to power operation of the sensor and the motor.

The continuous length of pleated paper toweling 44 is then loaded into the support frame 50. In particular, the continuous length of pleated paper toweling is placed upon the bottom platform 68 of the support frame 50 in the form of a vertical stack. The end 64 of the toweling 44 from which the discrete towel 34 is cut is located at the bottom of the vertical stack. The installer routes the bottom end 64 of the continuous length of pleated paper toweling 44 around the spacer roller 82 and then between the drive roller 62 and the pinch roller 74. The drive roller 62 is rotated to advance the bottom end 64 to a position adjacent to the opening 66 in the base 52 of the dispenser assembly 40. The drive roller can be rotated manually or automatically rotated by the controller.

In use, the user initiates a towel request by positioning an object, such as the user's hand, in sensing proximity to the sensor. Preferably the sensor does not require the user to contract the sensor or any other portion of the assembly 40. The sensor 46 activates the dispensing of the end 64 of the continuous length of pleated paper toweling 44 through the opening 66 in the base 52 of the assembly. Referring to FIG. 5, the dispensed predetermined length of the end 64 of the continuous length of pleated paper toweling extends below the dispenser assembly 40. In particular, the end 64 of the pleated paper toweling 44 extends downward from the base 52 such that the toweling is generally not in cutting contact with the cutter 48. The toweling is dispensed such that the toweling is not cut, but instead is positioned at a natural hanging position outside the dispenser housing 42 that causes a user to grasp and pull the toweling toward the user.

Pulling the dispensed end 64 of the toweling forward or toward the user (as represented by arrow A in FIG. 5) moves or forces the toweling against the cutter 48, which in turn causes the end 64 to be cut or separated from the continuous length of pleated paper toweling 44. The user is thereby provided with a predetermined length of discrete towel 34. If additional toweling is needed, the user can reactivate the dispenser assembly 40 by again placing an object in sensing proximity to the sensor 46.

When not in use, the end 64 of the continuous pleated paper toweling 44 is located generally within the towel dispenser assembly 40. That is, a lead portion of end 64 does not extend out from the opening 66 of the base 52. The next dispensed towel has therefore not been openly exposed, which can aid in maintaining towel quality. Because the end 64 of the toweling 44 is not openly or visually exposed, indicia 124 (FIG. 1) can be provided at a visible location on the dispenser assembly, or elsewhere, to indicate to a user how to initiate a towel request. In the alternative, the controller can be configured to dispense a portion of the predetermined length of the following end 64 of the toweling 44 after the user has taken the dispensed toweling, or after a predetermined period of time.

The above specification provides a complete description of the present invention. Since many embodiments of the invention can be made without departing from the spirit and scope of the invention, certain aspects of the invention reside in the claims hereinafter appended.

What is claimed is:

1. A towel dispensing assembly for installation within an existing paper towel dispenser cabinet, the towel dispensing assembly comprising:

a) a support frame having a generally rectangular construction with an open bottom, the support frame for insertion into and attachment to an existing paper towel dispenser cabinet, the support frame including a support platform for supporting a stack of a continuous length of pleated paper toweling, the support platform being connected to a portion of the support frame and at least partially covering the open bottom;

b) a base connected to the open bottom of the support frame, the base having a bottom discharge opening for dispensing the paper toweling therethrough;

c) a drive roller and a pinch roller;

d) a spacer roller rotatably mounted to the support frame and supporting the support platform, the spacer roller being disposed adjacent the support platform for partially supporting the stack of pleated paper toweling and being configured to route the continuous length of pleated paper toweling from between a bottom of the stack and the support platform and toward the drive roller and the pinch roller;

e) the drive roller and the pinch roller being located beneath the support platform and the spacer roller;

f) a sensor that activates a dispensing operation of the drive roller; and g) a stationary cutter located on the base and below the drive roller and the pinch roller, the stationary cutter having a blade adjacent to the discharge opening for cutting a discrete towel from an end of the continuous length of pleated paper toweling dispensed by the drive roller responsive to a pulling force exerted by a user on the paper toweling against the stationary cutter.

2. The assembly of claim 1, wherein the sensor activates the dispensing operation when a user initiates a towel request, the towel request being initiated by positioning an object in sensing proximity of the sensor.

3. The assembly of claim 1, further including a motor that drives the drive roller.

4. The assembly of claim 3, further including a controller that controls operation of the motor, wherein the sensor signals the controller to dispense the predetermined length of the continuous length of pleated paper toweling.

5. The assembly of claim 4, wherein the controller controls the predetermined length of the continuous length of pleated paper toweling dispensed.

6. The assembly of claim 5, wherein the controller controls the predetermined length of the continuous length of pleated paper toweling dispensed based upon an input entered into the controller.

7. The assembly of claim 1, further including the continuous length of pleated paper toweling.

8. The assembly of claim 7, wherein the continuous length of pleated paper toweling has a plurality of alternating fold lines to form the stack.

9. The assembly of claim 7, wherein the stack is a vertical stack, and wherein a bottom end of the continuous length of pleated paper toweling from which a discrete towel is to be cut is routed between the pinch roller and the drive roller.

10. A towel dispensing assembly for installation within an existing paper towel dispenser cabinet, comprising:

a) a continuous length of pleated paper toweling provided as a stack;

b) a dispenser housing having a discharge opening for dispensing the paper toweling therethrough, the dispenser housing for insertion into and attachment to an existing paper towel dispenser cabinet, the stack of the continuous length of pleated paper toweling stored within the dispenser housing, the dispenser housing including a support platform supporting the stack of the continuous length of pleated paper toweling, the support platform being connected to a portion of the dispenser housing;

c) a drive roller and a pinch roller;

d) a spacer roller rotatably mounted to the dispenser housing and supporting the support platform, the spacer roller partially supporting the stack of pleated paper toweling and being configured to route the continuous length of pleated paper toweling from between a bottom of the stack and the support platform and toward the drive roller and the pinch roller;

e) the drive roller and the pinch roller being located beneath the support platform and the spacer roller, the drive roller and the pinch roller pinching the continuous length of pleated paper toweling between the drive roller and the pinch roller and routing the continuous length of pleated paper toweling toward the discharge opening of the dispenser housing;

f) a motor that drives a rotation of the drive roller;

g) a sensor that activates the drive roller to dispense the end of the continuous length of pleated paper toweling; and h) a stationary cutter located on a base of the dispenser housing and below the drive roller and the pinch roller, the stationary cutter having a blade adjacent to the discharge opening constructed to cut a discrete towel from the end of the continuous length of pleated paper toweling responsive to a pulling force exerted by a user on the paper toweling against the stationary cutter.

11. The towel dispensing assembly of claim 10, wherein the sensor activates the drive roller to dispense the end of the continuous length of pleated paper toweling when a user initiates a towel request.

12. The towel dispensing assembly of claim 11, wherein the sensor is activated by positioning an object in sensing proximity of the sensor.

13. The towel dispensing assembly of claim 10, wherein the drive roller dispenses a predetermined length of the continuous length of pleated paper toweling.

14. The towel dispensing assembly of claim 13, wherein the dispensed predetermined length of the end of the continuous length of pleated paper toweling extends below the dispenser housing.

15. The towel dispensing assembly of claim 10, further including a controller that controls operation of the motor, wherein the sensor signals the controller to dispense the end of the continuous length of pleated paper toweling.

16. The towel dispensing assembly of claim 10, wherein the continuous length of pleated paper toweling has a plurality of alternating fold lines to form the stack.

17. The towel dispensing assembly of claim 10, wherein the stack is a generally vertical stack, and wherein the dispenser housing has a storage region that stores the generally vertical stack, the end of the continuous length of pleated paper toweling from which the discrete towel is to be cut being located at a bottom of the generally vertical stack.

18. The towel dispensing assembly of claim 10, wherein the continuous length of the pleated paper toweling dispenses from the stack through a gap between the support platform and the dispenser housing.

* * * * *